United States Patent [19]

Knecht

[11] Patent Number: 4,751,996

[45] Date of Patent: Jun. 21, 1988

[54] STORAGE DEVICE FOR CIGARETTES OR THE LIKE

[75] Inventor: Siegfried Knecht, Gevelsberg, Fed. Rep. of Germany

[73] Assignee: Maschinenfabrik Alfred Schmermund GmbH & Co., Gevelsberg, Fed. Rep. of Germany

[21] Appl. No.: 879,884

[22] Filed: Jun. 30, 1986

[30] Foreign Application Priority Data

Jul. 2, 1985 [DE] Fed. Rep. of Germany ..... 3523588

[51] Int. Cl.[4] ..... B65G 1/00

[52] U.S. Cl. ..... 198/347; 198/560; 198/634

[58] Field of Search ..... 198/347, 524, 560, 633, 198/634; 131/909, 282, 283

[56] References Cited

U.S. PATENT DOCUMENTS

| | | | |
|---|---|---|---|
| 2,799,384 | 7/1957 | Rutherford | 198/560 |
| 3,305,128 | 2/1967 | Dearsley | 198/560 |
| 3,565,237 | 2/1971 | Strydom | 198/524 |
| 3,567,048 | 3/1971 | Whitham | 198/633 |
| 3,612,510 | 10/1971 | Dickson | 198/560 |
| 3,858,708 | 1/1975 | Hollenton et al. | 198/633 |
| 3,967,858 | 7/1976 | Atwell et al. | 198/524 |
| 4,078,648 | 3/1978 | Hinchcliffe | 198/347 |
| 4,149,545 | 4/1979 | Hall | 198/347 |
| 4,201,507 | 5/1980 | Hinchcliffe | 198/347 |
| 4,413,640 | 11/1983 | Wahle et al. | 198/347 |

FOREIGN PATENT DOCUMENTS 2005850 12/1969 France .

*Primary Examiner*—Randolph A. Reese
*Assistant Examiner*—Anthony Knight
*Attorney, Agent, or Firm*—Chilton, Alix & Van Kirk

[57] ABSTRACT

The temporary storage of bar-shaped objects such as cigarettes intermediate the manufacturing and packaging apparatus therefor is improved by sensing gaps in the supply within the storage system and engaging the objects upon detection of such a gap to prevent uncontrollable sudden movement thereof.

13 Claims, 1 Drawing Sheet

STORAGE DEVICE FOR CIGARETTES OR THE LIKE

BACKGROUND OF THE INVENTION

1. Field of the Invention

The present invention relates to the packaging of generally bar-shaped objects, cigarettes for example, and particularly to the temporary storage of such objects as may be required during a packaging procedure. More specifically, this invention is directed to an accumulator for bar-shaped objects which provides for temporary storage thereof while insuring gentle treatment of the objects. Accordingly, the general objects of the present invention are to provide novel and improved methods and apparatus of such character.

2. Description of the Prior Art

While not limited thereto in its utility, the present invention has been found to be particularly well-suited for use in connection with the formation and subsequent packaging of cigarettes. The cigarette industry has found it desirable to provide for the temporary storage of cigarettes intermediate the manufacturing apparatus and the packaging apparatus. Such storage is useful, for example, to temporarily accumulate cigarettes should a fault occur in the packaging process, such accumulation allowing the manufacturing apparatus to continue to operate while the fault is located and rectified. One known accumulator for use in the cigarette industry has a plurality of horizontally oriented and vertically spaced channels defining a generally zig-zag shaped receiving area. Conveying belts at the bottom of the channels transport the cigarettes to the ends of the channels where the cigarettes move downwardly under the influence of gravity to the next lower channel.

Present accumulators operate satisfactorily if the supply of cigarettes from the manufacturing apparatus is constant. However, if there is a gap in the supply, that gap will move through the accumulator. When the gap reaches the end of a channel, the cigarettes following the gap will drop into the next lower channel. During the free fall from one channel to the next channel, the cigarettes may assume slanted positions and such slanted cigarettes will be likely to cause jams and constipations.

SUMMARY OF THE INVENTION

The present invention overcomes the above-briefly discussed and other deficiencies and disadvantages of the prior art by providing a novel and improved technique for the temporary accumulation of objects, particularly bar-shaped objects such as cigarettes, wherein free vertical fall of the objects is prevented. The present invention also encompasses apparatus for use in the practice of this novel technique.

Apparatus in accordance with a preferred embodiment of the present invention includes an upper inlet to which objects which require temporary storage are directed. A series of vertically spaced conveying channels provide communication between the upper inlet and an outlet or discharge which is vertically displaced from the inlet. Objects disposed in these conveying channels are moved on belts. Arcuate deflection sections are provided at the end of each of the vertically spaced conveying channels to turn the objects about a 180° "corner" whereby the objects may move in opposite directions in adjacent channels. A transfer element is associated with each arcuate deflection section. The transfer elements are rotatable about the axes of the deflection sections. The transfer elements are positionable so as to be out of the stream of objects moving in the conveying channels and may be rotated to a position where they will extend across the associated channel and function as moving stops for controlling the transfer of the objects from an upper conveying channel to the next lower conveying channel. Accordingly, upon the sensing of a gap in the supply of objects in a particular conveying channel, the transfer element associated with that channel is activated to engage the objects and to prevent the free fall thereof as they move from level-to-level within the accumulator. Thus, the cigarettes or other objects reaching the discharge end of the accumulator, where they are returned to the main conveying system, have been controlled so that they remain in the desired orientation for receipt by the downstream packaging machinery.

BRIEF DESCRIPTION OF THE DRAWING

The present invention may be better understood and its numerous objects and advantages will become apparent to those skilled in the art by reference to the accompanying drawing wherein like reference numerals refer to like elements in the two figures and in which.

DESCRIPTION OF THE DISCLOSED EMBODIMENT

Figure 1:
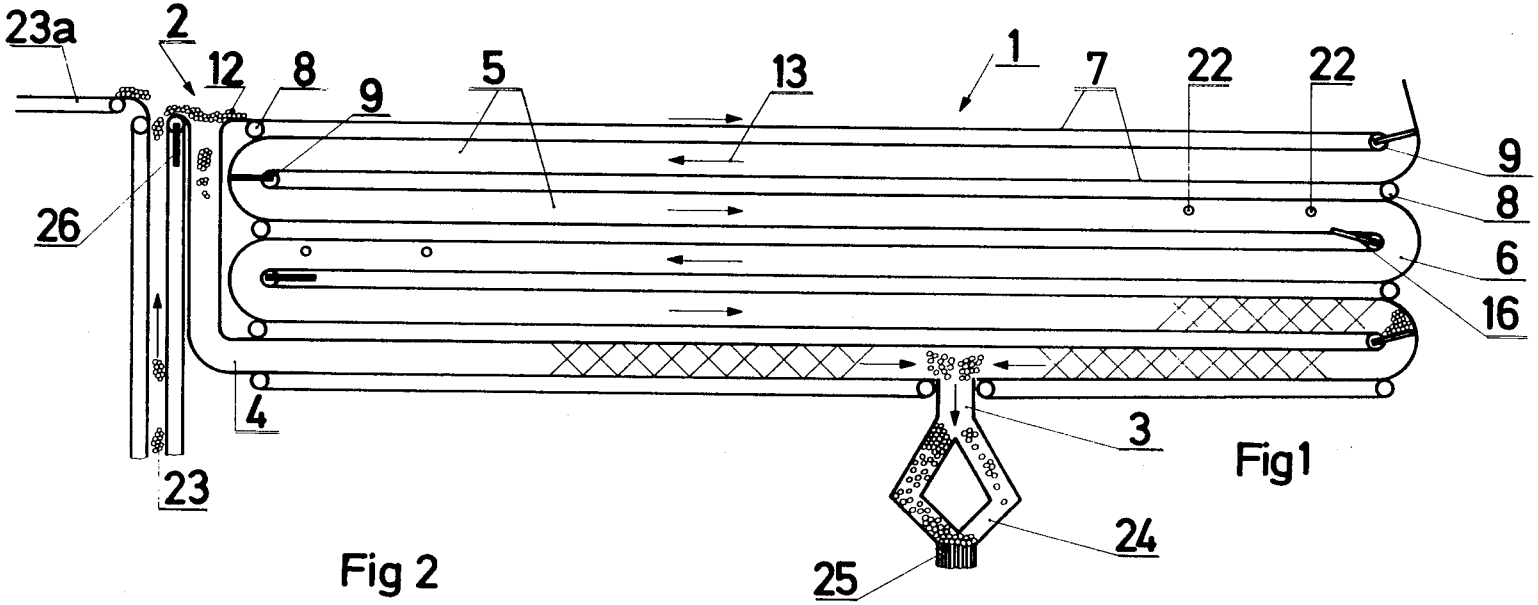
FIG. 1 is a schematic side elevation view of an intermediate storage device for cigarettes in accordance with the present invention.

With reference now to the drawing, a storage device or accumulator in accordance with the present invention is indicated in FIG. 1 generally at 1. Storage device 1 has an inlet 2 and an outlet or discharge 3. The inlet 2 is located at the highest level of the storage device while the discharge 3 is at the lowest level thereof. Accordingly, the cigarettes, which have been indicated at 12, which are delivered to the storage device 1 will move therethrough between the inlet and discharge in part under the influence of gravity. A generally L-shaped main conveying channel 4 extends from the vicinity of the inlet 2 of the storage device to the outlet 3 thereof. The path of normal cigarette flow, as will be discussed in greater detail below, is through the conveying channel 4. The receiving device 1 is in the form of a plurality of generally parallel conveying channels 5 which are arranged one above the other. The individual conveying channels 5 are connected to the adjacent channel or channels by means or arcuate deflection sections 6. This interconnected arrangement of conveying channels, i.e., the zig-zag shaped receiving area defined by the channels and deflection sections, is characterized by a high degree of volumetric efficiency.

Figure 2:
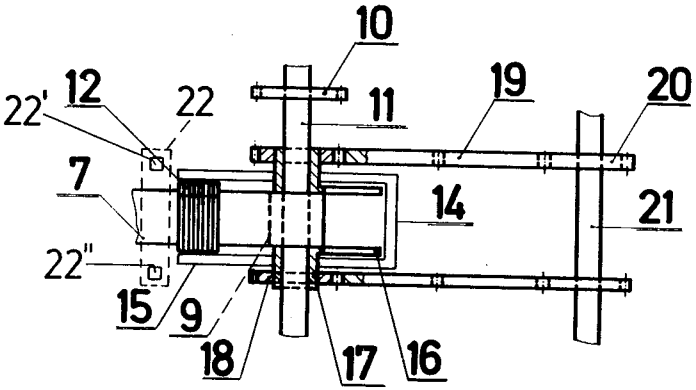
FIG. 2 is a schematic top plan view of a portion of the apparatus of FIG. 1, FIG. 2 depicting a deflection section between a pair of adjacent but vertically displaced conveying channels of the FIG. 1 apparatus.

In the disclosed embodiment, the uppermost conveying path or channel is open upwardly. The storage volume of the lower channels is defined by parallel conveying belts 7 which are guided about deflection rollers 8 and 9. Thus, with the exception of the uppermost channel, each of the conveying channels 5 is defined by a pair of spaced belts which move in the same direction. The deflection rollers 9 are each arranged on a shaft 11 which, as may be seen from FIG. 2, is driven via a gear wheel 10. All of the rollers 9 are driven from a common drive, not shown.

With the exception of the portion of the main or normal conveying channel 4 located to the right of the discharge 3 in the disclosed embodiment, the conveying belts 7 extend over the length of the conveying channels 5, i.e., between a pair of oppositely disposed and oriented deflection sections 6. The cigarettes 12 located in a conveying channel 5 are arranged in several layers, one above the other, and take up the entire height of the channel. The direction of movement of the stacked cigarettes in the channels is indicated by the arrows 13.

The deflection sections 6 of the storage device 1 are defined by circular arc-shaped deflection plates 14. As may be seen from FIG. 2, the plates 14 are connected to the side walls 15 of the conveying channels 5. A transfer mechanism is associated with each of the deflection sections 6. In the disclosed embodiment the transfer mechanisms are in the form of a pair of bar-shaped transfer elements 16 which are arranged at opposite sides of each associated conveying belt 7. A sleeve 17, which can turn relative to the shaft 11, is supported on each shaft 11 at each side of roller 9. The transfer elements 16 are connected to respective of the sleeves 17. The transfer elements extend from the sleeves 17 approximately as far as the deflection plate 14, i.e., the transfer elements rotate about the axis of rotation of the associated rollers 9 and have a length which approaches the radius of the circle defined by the inner diameter of the deflection plates 14. The sleeves 17 each carry a pinion 18 which engages, via a gear wheel 19, a further gear 20. The two gears 20 for each transfer mechanism are connected to a rotary drive, not shown, via a common shaft 21. A pair of level sensors 22 are associated with each channel 5 and are located upstream of each deflection section 6. The level sensors 22 are separated by a predetermined horizontal distance and are located adjacent to the upper of the belts which defines the top of the conveying channel 5 in which the sensors are arranged. The level sensors 22 are typically optical devices such as, for example, cooperating light sources 22' and sensors 22'' disposed at opposite sides of the conveying channel.

The spacing between the level sensors 22 will be commensurate with the maximum gap in the supply of cigarettes moving through the channels which can be tolerated. Any gap larger than that which can be tolerated will be indicated by the simultaneous generation of signals by both level sensors 22 in the channel. In the context of the present invention, a gap which cannot be tolerated is one of sufficient length so that cigarettes 12 in the area of the particular deflection section 6 will free fall into the next lower conveying channel if the gap is permitted to reach the deflection section 6. Restated, an intolerable gap is one which will result in the emptying of a deflection section 6.

Should both of the level sensors provide an output signal, indicative of an undesirable gap in the supply of cigarettes in a channel, the rotary drive for the transfer elements 16 associated with that channel will be actuated. This will result in the transfer elements 16 being rotated in the direction of cigarette movement from their initial position, in which they are arranged outside the deflection section 6 and parallel to the conveying belt 7, through an angle in the range of 90–180 degrees. This rotation will result in the transfer elements moving, i.e., stepping, into a blocking position whereby the upper conveying channel 5 of the conveying channel pair which is interconnected by the deflection section 6 is blocked. This blocking of the upper of a pair of adjacent conveying channels, i.e., the channel in which the level sensors which have provided the alarm signal are located, causes the cigarettes 12 in the storage device to collect in front of the transfer elements 16. When the level detectors 22 are de-energized, thus indicating that the area monitored thereby has been filled by cigarettes 12, the rotary drive for the transfer elements 16 is reactuated to cause the transfer elements to rotate further in the direction of their original motion and to ultimately return to their initial position. During such further rotation, the cigarettes which have backed-up behind the transfer elements will be carried gently down into the next lower conveying channel. Thus, the transfer elements will serve to control the movement of the cigarettes while in the deflection sections 6 so that they cannot fall from one conveying channel 5 into the next lower conveying channel 5 via the deflection sections 6. It is to be noted that in FIG. 1 the various transfer elements 16 are represented in various positions.

In the apparatus shown in FIG. 1, a pair of feeds 23 and **23*a* are provided for the storage device 1. The feed 23 comprises a vertical conveyor system while the feed 23*a* is a horizontal conveyor. Blocking elements 26, which will typically be devices having the same form as the transfer elements 16, are provided at the inlet 2 of storage device 1. The blocking elements 16 are employed to close the feed 23 when the latter does not contain any cigarettes so that the storage device 1 may continue to be supplied via the feed 23*a***.

The discharge 3 of storage device 1, in the disclosed embodiment, is shown as being coupled to the cigarette funnel 25 of a packaging machine via a branch 24.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. In apparatus for use in the temporary storage of cigarettes, said storage apparatus including a plurality of generally horizontally oriented and vertically spaced conveying channels which define a zig-zag shaped reservoir, each of the channels including lower conveyor means on which the cigarettes travel, at least one of said channels being defined by a pair of generally parallelly arranged conveyor belts which extend over the length of the said one channel and respectively define upper and lower channel surfaces, vertically adjacent channels sharing an endless conveyor belt which defines a lower surface of the upper channel and an upper surface of the adjacent lower channel, the storage apparatus further including a cigarette inlet and a cigarette discharge which is vertically spaced from the inlet, the improvement comprising:

means for coupling adjacent channels, said coupling means each including a deflection section having an outer wall which defines an arc of a circle, the axes of said outer wall defined arcs being oriented generally horizontally;

transfer means associated with each of said coupling means, said transfer means each including at least a first transfer element for selectively engaging and supporting cigarettes during movement thereof through the deflection section of the associated coupling means whereby free fall of cigarettes from a first upper conveying channel to an adjacent lower conveying channel via the deflection section is prevented, said transfer elements each being supported for rotation about the axis of its associated deflection section outer wall and extending radially substantially to the said outer wall, said transfer elements each being positioned laterally adjacent to conveyor means in a conveying channel which delivers the cigarettes to the deflection section;

detector means for detecting a gap in the supply of cigarettes traveling in a channel which exceeds a predetermined minimum gap length, said detector means being located upstream in the direction of movement of the cigarettes in the conveying channels from a said deflection section; and rotary drive means responsive to the detection of a gap exceeding the predetermined minimum for causing said transfer means transfer element to engage the cigarettes traveling in the channel in which the excessive gap has been detected.

2. The apparatus of claim 1 wherein said storage apparatus is interpositioned between the point of manufacture and the point of packaging of the cigarettes and wherein at least one of said channels is in part defined by a pair of said endless parallel conveyor belts, the lower of the belts of said pair passing about a deflection roller which is coaxial with said deflection section outer wall defined arc.

3. The apparatus of claim 2 wherein said transfer means transfer elements each include:

at least a first arm, said arm having a length commensurate with the radius of the inner diameter of said deflection section outer wall.

4. The apparatus of claim 3 wherein said transfer means transfer elements each further comprise:

a second arm, said second arm having a length commensurate with the radius of the inner diameter of said deflection section outer wall;

said first and second arms being located at opposite sides of the said lower of said belts.

5. The apparatus of claim 4 wherein said detecting means each comprise:

a pair of spaced optical sensors, said sensors each including a light source and a light detector spaced at opposite sides of a channel.

6. The apparatus of claim 5 wherein said transfer means has a first stored position wherein said first and second arms are generally parallel to one another and to the belts which define the associated channel, and wherein said arms are rotated through a first step in the direction of movement of cigarettes in said associated channel upon actuation so as to block said channel.

7. The apparatus of claim 6 wherein said arms are rotated in the same direction as said step and back to their stored position upon the sensing of cigarettes in front of both of said sensors.

8. The apparatus of claim 3 wherein said detecting means each comprise:

a pair of spaced optical sensors, said sensors each including a light source and a light detector spaced at opposite sides of a channel.

9. The apparatus of claim 3 wherein said transfer means has a first stored position wherein said first arm is oriented generally parallel with respect to said belt and wherein said arm is rotated in the direction of belt movement through a first step upon actuation so as to block the upper of a pair of adjacent channels.

10. The apparatus of claim 1 wherein said endless belt passes about a deflection roller having its axis located on the axis of said deflection section outer wall defined arc.

11. The apparatus of claim 10 wherein said detecting means each comprise:

a pair of spaced optical sensors, said sensors each including a light source and a light detector spaced at opposite sides of a channel.

12. The apparatus of claim 1 wherein said detecting means each comprise:

a pair of spaced optical sensors, said sensors each including a light source and a light detector spaced at opposite sides of a channel.

13. The apparatus of claim 1 wherein said transfer means transfer elements each include:

at least a first arm, said arm having a length commensurate with the radius of the inner diameter of said deflection section outer wall.

* * * * *